United States Patent [19]

Burton

[11] 4,000,597

[45] Jan. 4, 1977

[54] DECORATIVE TRIM FOR BUILDINGS

[75] Inventor: Richard Burton, Philadelphia, Pa.

[73] Assignee: Burton Aluminum Classics, Inc., Philadelphia, Pa.

[22] Filed: Mar. 4, 1975

[21] Appl. No.: 555,152

[52] U.S. Cl. ..... 52/716; 29/513; 52/494

[51] Int. Cl.[2] ..... E04C 2/40; E04F 19/02

[58] Field of Search ..... 29/513, 521; 113/116 CC; 52/311, 312, 716, 494, 495, 242; 220/23.2, 3.2, 3.3, 3.4

[56] References Cited

UNITED STATES PATENTS

| | | | |
|---|---|---|---|
| 252,428 | 1/1882 | Cashen | 220/23.2 |
| 255,706 | 3/1882 | Vuillier | 220/23.2 |
| 356,523 | 1/1887 | Chalifoux | 52/312 |
| 1,239,243 | 9/1917 | Wuensch | 29/513 |
| 1,424,658 | 8/1922 | Lidstone | 52/717 |
| 1,426,277 | 8/1922 | Conant | 52/717 |
| 2,316,035 | 4/1943 | Westrope | 52/312 |
| 2,520,725 | 8/1950 | Judd | 220/3.3 |
| 2,963,783 | 12/1960 | Field | 112/116 CC |

*Primary Examiner*—James L. Ridgill, Jr.
*Attorney, Agent, or Firm*—Synnestvedt & Lechner

[57] ABSTRACT

Any of a variety of trim pieces or components for buildings, the components having decoration according to a system providing for use of a wide variety of specific decorative patterns. The system provides for attachment to a trim or trim piece of separate means providing a decorative visual contrast with the trim piece itself.

7 Claims, 17 Drawing Figures

Fig. 1
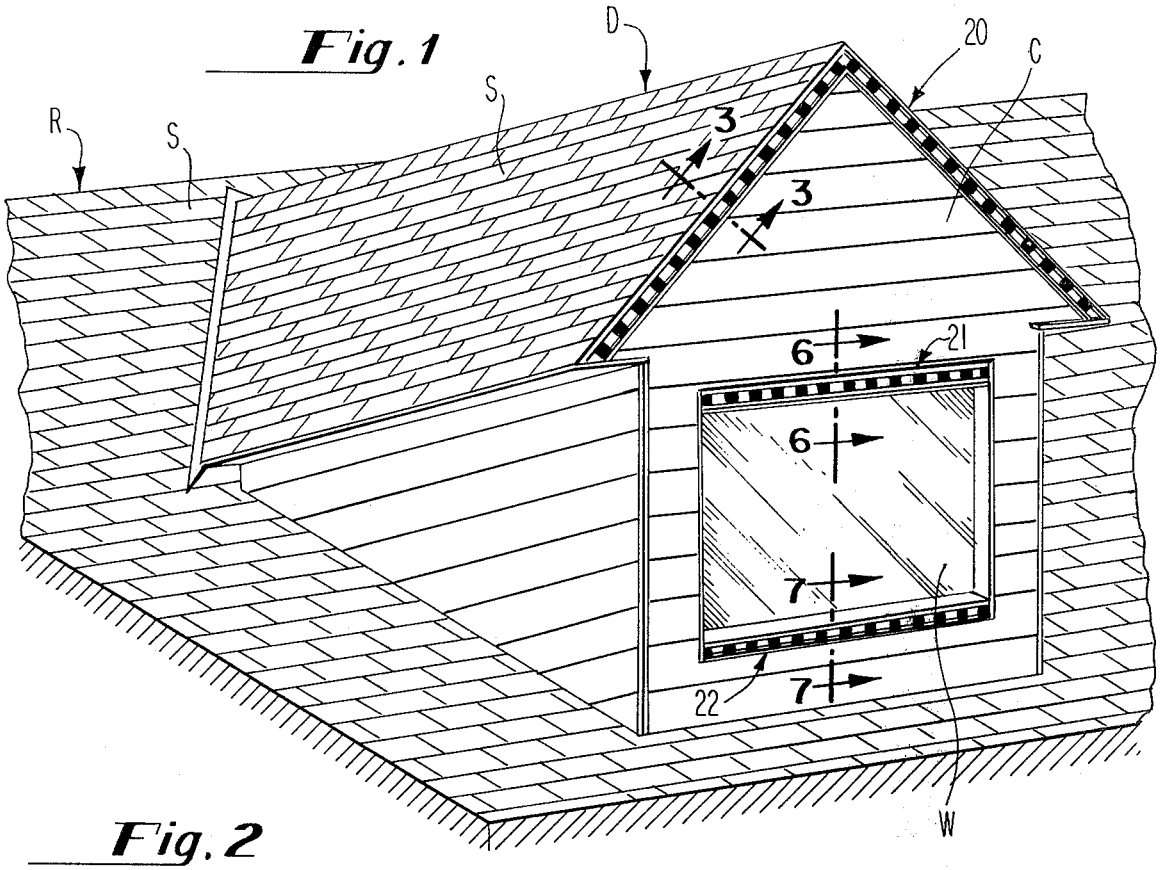
Fig. 2
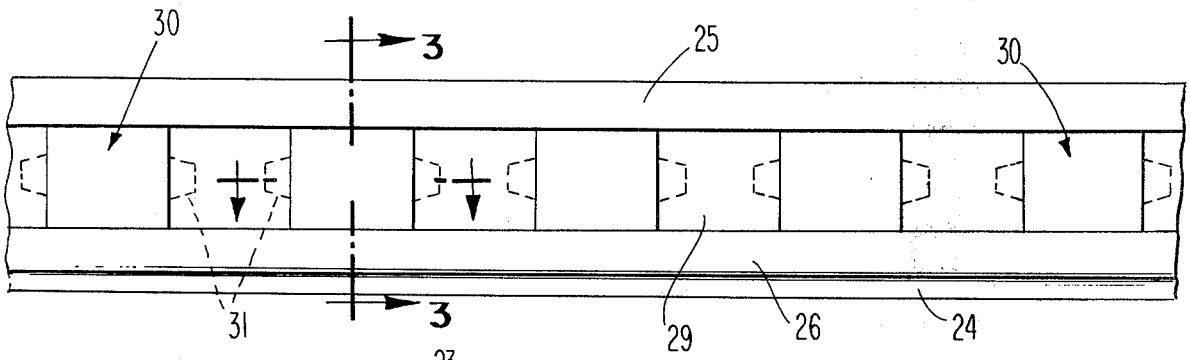
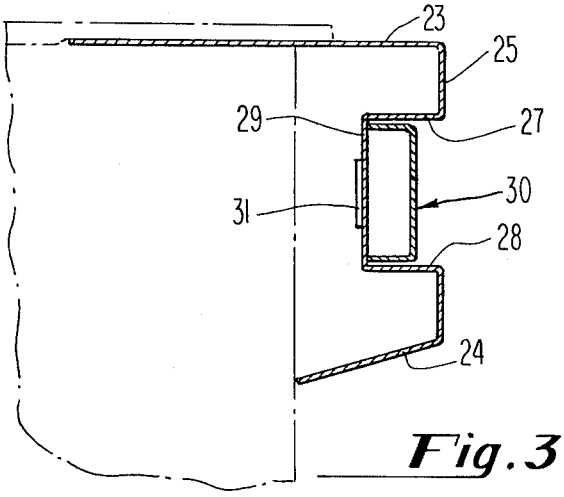
Fig. 3
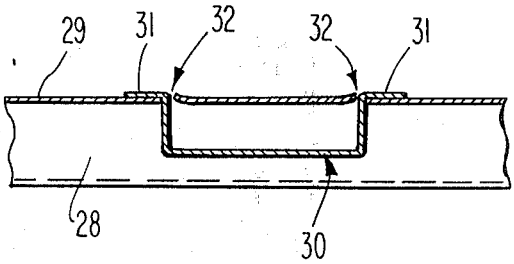
Fig. 4

35
36
37
38
39
40
25
26
29
33
34
1
2
3
4
5
6
II

DECORATIVE TRIM FOR BUILDINGS

BACKGROUND AND STATEMENT OF INVENTION

The present invention is concerned with decorative trim pieces or components for buildings, especially for homes or residences, and the invention is particularly concerned with the use of trim or trimming components imparting a decorative effect to the building.

The invention contemplates a system for mounting decorative elements imparting a decorative visual contrast to trim or trimming components of any of a wide variety of types, adapted to be positioned at various different parts of a building. For example, the decoration system of the invention is applicable to such trim components as roof caps, soffits, fascia, cornice pieces, window sills, water tables for use above windows, and various other trim pieces such as those employed at corners of building walls or at upright edges of window or door frames. As is known, such trim components are formed in a wide variety of shapes or profiles and are applied to buildings of various different types of construction, such as plaster or stucco, clapboard or siding, brick, stone, as well as various synthetic material reproduction of these building materials.

The system of decoration provided by the invention is applicable to any of the foregoing types of trim or trim components and it is an object of the invention to provide a system by which a wide variety of decorative effects may readily and inexpensively be secured, thereby providing many distinctive or individualized decorative effects from one building to the next. This aides in avoiding monotonous reproduction of exactly the same appearance, from house to house, particularly in housing developments.

A typical trim or trim component of known type has a shaped profile or cross section frequently including an elongated flat strip and according to the preferred practice of the invention, separate means are associated with such a strip, providing a decorative contrast with the strip, for instance, providing a color contrast with the strip. The system of the invention contemplates an arrangement in which the shaped profile and the separate decorative means have interfitting portions which retain the decorative means in the desired position with respect to the shaped profile of the trim.

In one preferred embodiment, the decorative means comprises a plurality of spaced decorative elements having mounting tabs which are inserted in slots formed in the profile, for instance in the flat strip thereof above referred to.

In accordance with another aspect of the invention, provision is made for employment of decorative elements which are of sheet form, with a variety of shapes or outlines, lying against a surface of the trim, or alternatively, in the form of elements which are three-dimensional and present a relief effect against the underlying trim surface.

In accordance with still another aspect of the invention, provision is made for the distribution of mounting slots on a trim component in a series or sequence, alternate spacing of slots being different, thereby providing for cooperation with and mounting of decorative elements of different dimensions, as will be more fully explained hereinafter.

Still further, it is an object of the invention to provide a trim system of the kind referred to embodying separate decorative means which are separable from the trim, so that the decorative effect may be altered by removing trim elements and replacing them with others.

BRIEF DESCRIPTION OF DRAWINGS

How the foregoing and other objects and advantages are obtained will be clear from the following description of the accompanying drawings, in which:

FIG. 1 is a fragmentary perspective view of a portion of a house including a portion of the roof thereof and also of a dormer window structure projecting from the roof, and having certain decorative trim components of the type contemplated by the present invention applied in the position of the cornice of the dormer window structure and also in the position of the water table and sill of the window shown;

FIG. 2 is an enlarged elevational view of a portion of the cornice shown in FIG. 1;

FIG. 3 is an enlarged fragmentary sectional view taken as indicated by the section line 3—3 on FIG. 2, this line also being indicated on FIG. 1;

FIG. 4 is an enlarged fragmentary horizontal sectional view taken as indicated by the section line 4—4 on FIG. 2;

DETAILED DESCRIPTION OF DRAWINGS

Figure 5:
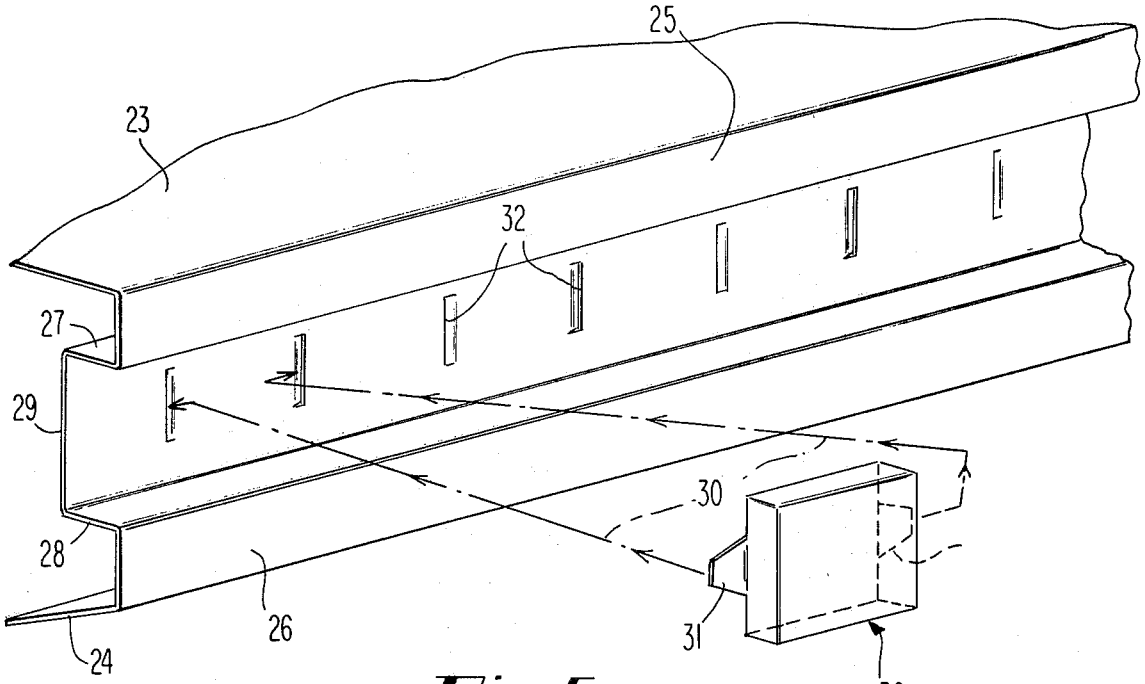
FIG. 5 is an isometric view of a portion of a trim component, such as the cornice of FIGS. 2, 3 and 4, further illustrating the arrangement for mounting of the individual decorative elements.

The main roof of the building fragmentarily shown in FIG. 1 is indicated generally at R and the dormer structure is indicated generally at D. Both the main roof and the dormer roof are covered with shingles S and the vertical walls of the dormer structure are here shown as covered with siding or clapboard C. In the outer end of the dormer, there is a window, in this instance indicated as a single pane "picture" windown W.

FIG. 1 also shows decorative trim components of three types. Thus at the end of the dormer roof there is a decorated cornice 20, and above the window there is a decorated water table 21 and below the window a decorated sill 22. These decorated trim components are illustrated and described more fully hereinafter in connection with other figures of the drawings.

It is here to be noted that the illustration of FIG. 1 represents only one of a number of structures which may be decorated by the employment of decorative trim components according to the present invention. In addition to the particular decorated components (20, 21 and 22) shown in FIG. 1, other trim components may also be decorated according to the same general system, including for example vertical or side trim components at the vertical edges of the window, or corner trim components, such as those which appear in FIG. 1 at the vertical outer edges of the dormer structure between the outer dormer wall and the side or cheek walls of the dormer. The decorative system of the invention may also be applied to a wide variety of other trim components not shown in FIG. 1, as already pointed out.

The construction of a typical decorated cornice trim component according to the present invention is illustrated in greater detail in FIGS. 2, 3, 4 and 5. From FIGS. 3 and 5 it will be seen that the cornice trim there shown has a shaped profile, and for purposes of illustration it is assumed that this profile is formed of sheet metal, such as aluminum. However, it will be understood that this trim component, as well as various other trim components, may be formed of other materials, notably plastic materials such as rigid polyvinyl chloride of the type used in making siding boards. In either event, the profile is thinned walled or sheet-like. The component shown in FIGS. 2 to 5 has top and bottom strips 23 and 24, vertical strips 25 and 26, and a central channel formed by horizontal strips 27 and 28 and by a bottom flat strip 29. Although various of the strips of the profile may be decorated in accordance with the principals of the decoration system herein disclosed, the decoration here shown is applied in the central channel of the profile and specifically is applied to the bottom wall 29 of that channel.

In the specific embodiments shown in FIGS. 2 to 5, it is considered that both the trim components as well as the separate decorative elements are formed of sheet metal such as aluminum. The decorative elements here shown comprise rectangular three-dimensional elements generally indicated at 30. These may take a variety of forms but in the embodiment shown they comprise box-like structures open at the back side and folded from appropriately stamped sheet metal, to provide an imperforate front or face wall and four edge walls, together with two laterally projecting tabs 31, 31 as clearly appears in FIGS. 2 to 5.

As best seen in FIG. 5, the flat strip 29 at the base of the channel of the cornice trim here shown, is provided with a series of slots 32 for cooperation with the tabs 31 in mounting the decorative elements. The metal adjacent to these slots may conveniently be somewhat deflected as shown in FIG. 4 in order to facilitate insertion of the tabs through the slots when the decorative elements 30 are applied. Preferably also the side walls of the box are not joined at the four side wall corners. This permits manual deformation of the metal of the side walls from which the tabs 31 project in order to permit insertion of the extremities of the tabs 31 into the slots 32, whereupon, either by resilence or by return deformation, the sheet metal of the element 30 may again be flexed to a position such as illustrated in FIG. 4 in which the mounting tabs 30 lie along the inside surface of the strip 29 of the trim profile. In this way the original rectangular shape of the element 3 is restored, with the side walls thereof extending perpendicular to the base strip 29 of the channel in which the decorative elments are mounted. The foregoing mounting technique is indicated in FIG. 5 by the dot dash lines 30*a* and the arrows associated with those lines.

The elements 30 may provide a decorative visual contrast in any of a variety of ways. For instance they may be of different color than the trim component itself, or they may be of different surface texture or sheen, as compared with that of the exposed surface of the strip 29 or of other portions of the profile of the trim component. Still further, since the components 30 in the embodiment here shown are three-dimensional, even if they have the same surface coloring and texture, they will stand out in relief, under various different lighting conditions and will in this manner contribute a decorative visual contrast with other portions of the trim profile.

Figure 14:
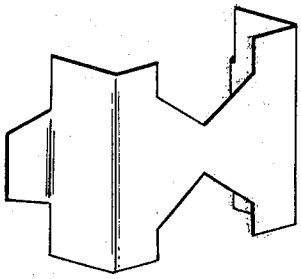
Figure 16:
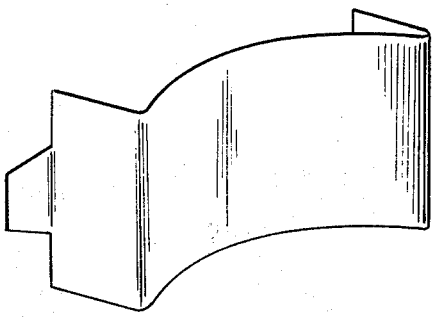
Figure 15:
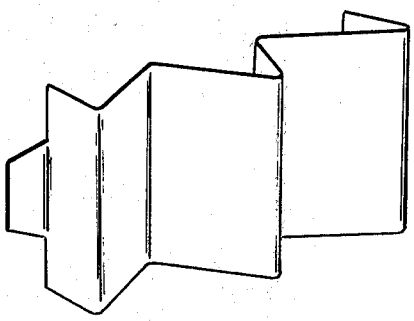

It will be understood that three-dimensional decorative elements of a wide variety of forms and shapes may be prepared and mounted according to the system as described above, for instance the forms of such devices illustrated in FIGS. 14, 15 and 16. These illustrate only three of an infinite variety of three-dimensional elements which may be employed.

Figure 17:
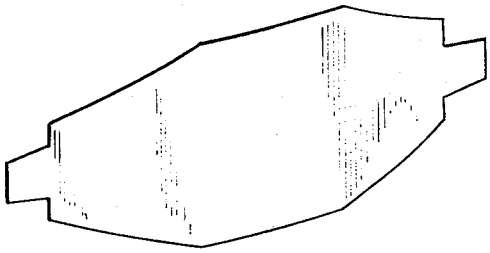
FIGS. 14, 15, 16 and 17 are isometric views of various typical individual decorative elements adapted to be used in the system according to the present invention.

If desired, the decorative elements need not necessarily have any substantial three-dimensional effect, but may comprise substantially flat strip elements lying closely against the surface of the trim on which they are mounted. In these cases, in order to provide a pronounced decorative effect it is preferred to employ elements having a different color, or having at least a different surface texture or sheen, as compared with the surface on which the elements are mounted. An example of one of many possible shapes of flat sheet type elements which may be employed is illustrated in FIG. 17.

In connection with any of the elements of FIGS. 14, 15, 16 and 17, it will be noted that they are all provided with mounting tabs, so that they may be mounted in the general manner described above and illustrated in FIG. 5. Because of this mounting arrangement, it will still further be understood that, if desired, the decorative effect of a given trim component may even be altered by removing decorative elements and replacing them with others of different color or configuration.

Figure 6:
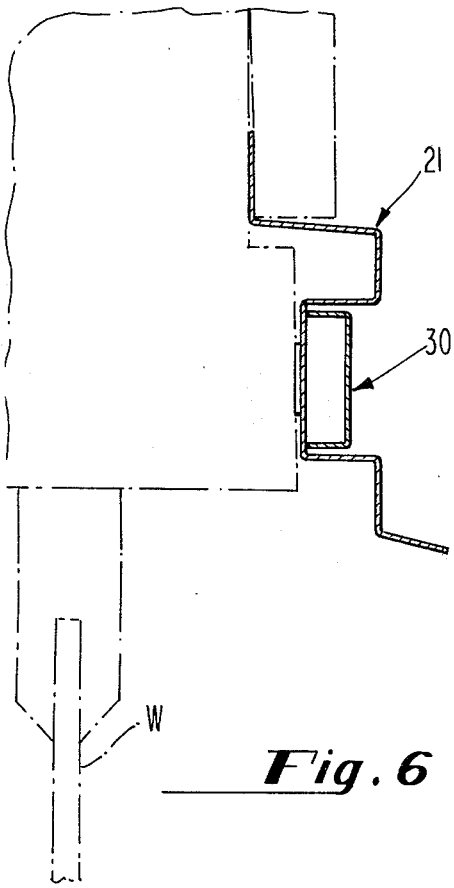
FIG. 6 is a fragmentary vertical section view of the water table shown in FIG. 1, taken as indicated by the section line 6—6 on FIG. 1.
Figure 7:
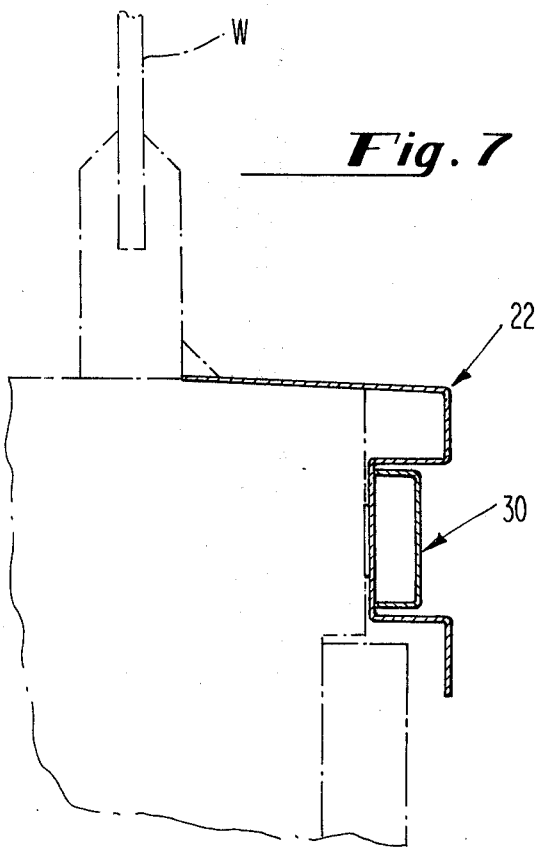
FIG. 7 is a fragmentary vertical sectional view of the window sill shown in FIG. 1, taken as indicated by the section line 7—7 on FIG. 1.

From FIGS. 1, 6 and 7, it will also be seen that the water table trim component 21 positioned above the window W, as well as the window sill 22, may be decorated in the same general manner as described above in connection with the trim profile shown in FIGS. 2, 3, 4 and 5. Similar variations in decorative effects as described above may also be employed in connection with the trim profiles shown in FIGS. 6 and 7, as well as in a wide variety of other trim components.

Figures 8, 9, 10, 11:
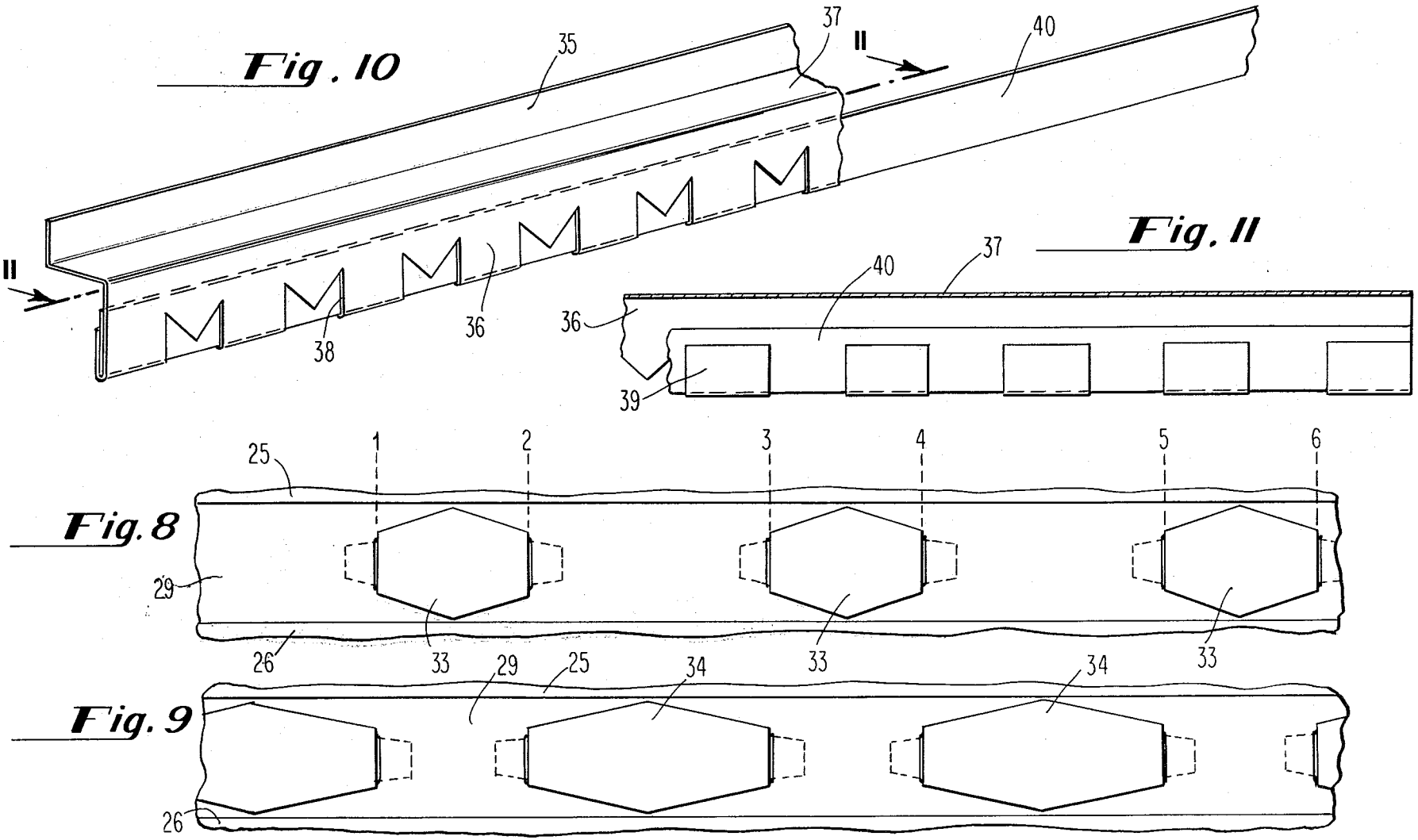
FIGS. 8 and 9 are fragmentary outline views illustrating alternative decorative element and alternate mounting arrangements.
FIG. 10 is an isometric view of a modified form of the system of decoration contemplated according to the present invention.
FIG. 11 is a fragmentary rear elevational view of the arrangement of FIG. 10, taken as indicated by the line 11—11 on FIG. 10.

FIGS. 8 and 9 illustrate another variant which may be utilized according to the present invention. These two figures each fragmentarily show the same portion of a trim component which for purposes of illustration, may be assumed to be of the same type shown in FIGS. 2 and 5. Here, however, the base strip 29 of the channel of the profile is provided with a series of mounting slots which are spaced from each other in the manner indicated by the dotted lines 1, 2, 3, 4, 5 and 6. It will be seen that the spacing between lines 1 and 2, 3 and 4, and 5 and 6, is smaller than the spacing between lines 2 and 3, and 4 and 5. Because of this difference in spacing of the mounting slots, provision is made in a very simple manner to provide capability for alternative use of decorative elements of different sizes. As seen in FIG. 8, three decorative elements 33 are employed, each being dimensioned to correspond with the spacing between the slots indicated by the dotted lines 1 and 2 (which is the same as that of lines 3 and 4, and of 5 and 6).

On the other hand, in FIG. 9 the decorative elements 34 are longer than the elements 33 of FIG. 8, and these longer elements are of length corresponding to the spacing between slots indicated by lines 2 and 3 (which, of course, is repeated for lines 4 and 5, and in other similar positions along the strip). Thus, by employment of mounting slots of different spacing, provision is made for multiplying the variety of decorative effects which can be secured with a given trim component. Still other distinctive variants are possible with an arrangement such as illustrated in FIGS. 8 and 9. For instance, still longer components may be mounted by means of the slots, for instance components corresponding to the spacing between the slots indicated by lines 1 and 3. If desired, moreover, components of different lengths may be integrated into a single decorative effect, thereby providing still another distinctive appearance.

It will be understood that in an embodiment such as shown in FIGS. 8 and 9, a virtually infinite number of shapes of elements may be utilized and further that these elements may be flat pieces or three-dimensional pieces providing a relief effect.

In FIGS. 10 and 11 another embodiment of the decorative system is shown. In these figures portions of a trim component are shown, this component having a profile including edge strips 35 and 36 with an intervening strip 37. The edge portion 36 of the profile is cut-out at intervals as indicated at 38 and intermediate tabs 39 are bent to provide for interengagement with the separate decorative means 40, which, in this case, may take the form of a strip having different color or surface texture as compared with the exposed surface of strip 36. In this way, the strip 40 provides a decorative visual contrast in each of the cut-outs 38.

Another arrangement similar to that shown in FIGS. 10 and 11 contemplates a smilarly bent strip or profile in which the cut-outs 38 are apertures stamped out of the strip 36 in spaced relation to the free edge of the profile, in which event, when viewed as in FIG. 11 there would be no longer be separated tabs 39, but the metal of this portion of the profile would be continuous thoughout the length of the piece. The constrasting strip such as indicated at 40 could still be employed, but where the cut-outs 38 are formed as apertures in the strip 36 only, it is also possible to eliminate the separate strip 40 and provide the visual decorative contrast merely by providing different colors on opposite sides of the sheet material of which the trim element is formed. The reverse side of the sheet material will be visible through the apertures in the strip 36, thus providing the decorative contrast.

Figure 12:
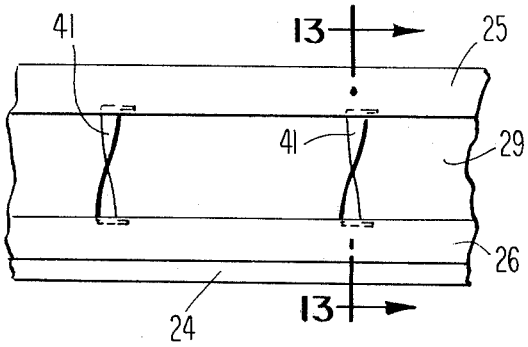
FIGS. 12 and 13 are fragmentary elevational and vertical sectional views of still another embodiment of a decorative trim according to the invention.
Figure 13:
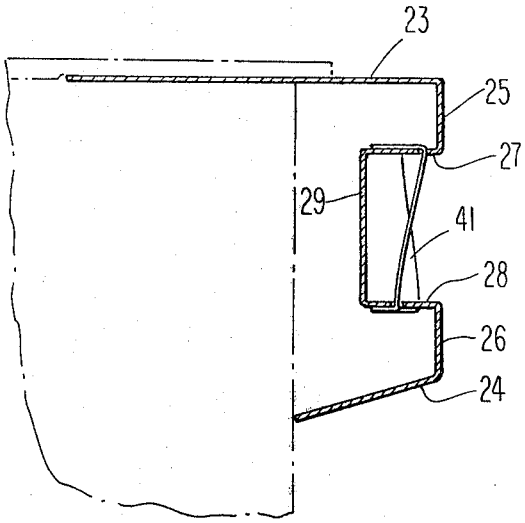

FIGS. 12 and 13 illustrate still another embodiment of the decorative system of the present invention. Here a trim profile of the kind shwown in FIGS. 2 and 5 is illustrated. Instead of employing decorative elements mounted by means of slots in the base wall 29 of the central channel of the trim component, a series of a spaced strip-like elements 41 are provided, having their ends received in slots provided in the edge walls 27 and 28 of the central channel. These components 41 may for example comprise twisted strips of different color, texture or sheen, as compared with other parts of the trim profile, thereby introducing a decorative visual contrast. Still further, decorative components of types similar to those indicated at 41 may be fastened or hung at one end only, from slots provided in the edge walls 27 or 28, thus providing still other decorative effects.

From the foregoing, it will be seen that the variety of decorative trim effects which may be obtained according to the present invention is virtually infinite, and further that the various decorative effects may be provided in a simple and inexpensive manner.

We claim:

1. A building trim formed of sheet material, the trim having a shaped cross sectional profile with an elongated flat strip inset from an adjoining part of the profile and having a series of slits spaced from each other lengthwise of the strip, and decorative means comprising a plurality of elements overlying said strip and of contrasting appearance as compared with the strip, said elements being spaced from each other lengthwise of the strip and each having spaced mounting parts extended into spaced slits and interconnecting the elements with the sectional profile, thereby providing a decorative visual contrast between said elements and said strip in areas spaced lengthwise of the strip.

2. A building trim as defined in claim 1 in which the cross sectional profile of the trim includes a channel having base and side strips and in which said flat strip comprises the base strip of the channel and still further in which the spaced slits are provided in said base strip.

3. A building trim as defined in claim 1 in which the slits are spaced from each other lengthwise of the strip in a series alternately having larger and smaller spacing, for alternatively cooperating with decorative elements of different sizes.

4. A building trim formed of sheet material and having a shaped cross sectional profile with an elongated exposed strip provided with spaced apertures, and decorative means connected with said strip comprising a plurality of longitudinally spaced elements each having spaced mounting parts extended into spaced apertures in said strip and each overlying an area of the strip between apertures, said elements providing a plurality of longitudinally spaced areas having decorative visual contrast with said strip.

5. A building trim formed of sheet material, the trim having a shaped cross sectional profile including a channel having elongated base and side strips the channel being inset from adjoining parts of the profile, the side strips of the channel each having a series of slits spaced from each other lengthwise of the strips, and decorative means comprising a plurality of elements overlying the base strip and of contrasting appearance as compared with the base strip, said elements being spaced from each other lengthwise of the channel and each having spaced mounting parts extended into spaced slits in the side strips and interconnecting the elements with the sectional profile thereby providing a decorative visual contrast between said elements and said base strip in areas spaced lengthwise of the strip.

6. A building trim having a shaped profile with an elongated, exposed and apertured strip, and means associated with said strip providing a decorative visual contrast with said strip, said means being connected with the trim and being positioned to be visible through the apertures in the strip.

7. A building trim in accordance with claim 6 in which the decorative means comprises another strip underlying said elongated, exposed and apertured strip.

* * * * *